US005207357A

United States Patent [19]

Aronie et al.

[11] Patent Number: 5,207,357

[45] Date of Patent: May 4, 1993

[54] EPOXY EJECTION GUN

[75] Inventors: Alan B. Aronie, Concord, Mass.; Joel Aronie, West Hartford, Conn.

[73] Assignee: Quikpoint, Inc., Concord, Mass.

[21] Appl. No.: 835,295

[22] Filed: Feb. 13, 1992

[51] Int. Cl.[5] ..... B67D 5/60

[52] U.S. Cl. ..... 222/134; 222/137; 222/390

[58] Field of Search ..... 222/134, 137, 145, 327, 222/333, 390, 287

[56] References Cited

U.S. PATENT DOCUMENTS

| | | | |
|---|---|---|---|
| 3,117,696 | 1/1964 | Herman et al. | 222/137 |
| 3,861,567 | 1/1975 | Davis, Jr. | 222/333 |
| 4,024,994 | 5/1977 | Davis, Jr. | 222/326 |
| 4,171,072 | 10/1979 | Davis, Jr. | 222/326 |
| 4,258,866 | 5/1981 | Bergman | 222/333 |
| 4,260,076 | 4/1981 | Bergman | 222/390 |
| 4,273,269 | 6/1981 | Davis, Jr. | 222/326 |
| 4,432,469 | 2/1984 | Eble et al. | 222/134 |
| 4,840,294 | 6/1989 | Ernst | 222/287 |
| 4,871,088 | 10/1989 | Cox | 222/47 |
| 4,913,553 | 4/1990 | Falco | 222/137 |
| 4,934,827 | 6/1990 | Taschke et al. | 222/137 |
| 5,058,781 | 10/1991 | Aronie et al. | 222/390 |
| 5,104,005 | 4/1992 | Schneider, Jr. et al. | 222/137 |

*Primary Examiner*—Andres Kashnikow
*Assistant Examiner*—Philippe Derakshani
*Attorney, Agent, or Firm*—Henry D. Pahl, Jr.

[57] ABSTRACT

In the epoxy ejection gun disclosed herein, a bridge member which couples and drives a pair of push rods includes a forward facing seat or socket, e.g. of conical shape. A lead nut engageable with a rotatable lead screw is provided with a surface matching the seat. An adjustable spring is provided for biasing the interfitting parts. Rotation of the lead screw causes the lead nut to advance driving the push rods but pressure is controlled by the selected value of biasing force on the matching surfaces, excessive force allowing the lead nut to rotate with the lead screw rather than to advance.

11 Claims, 3 Drawing Sheets

EPOXY EJECTION GUN

BACKGROUND OF THE INVENTION

The present invention relates to epoxy ejection guns and more particularly to such a gun in which pressure may be precisely controlled.

Increasingly, epoxy adhesives and other two-component bonding or embedment systems are being utilized in the construction trades. The components are typically packaged in dispensing tubes such as those used for caulking compounds. In order to effectively utilize these substances, it is necessary to provide a tool which effects simultaneous ejection of the two components from their respective dispensing tubes. Heretofore, most such commercially available epoxy ejection guns were pneumatically or hand operated which limited their general utility and were not well controlled in terms of modulating or limiting the pressure which could be applied to the dispensing tubes.

Among the several objects of the present invention may be noted the provision of a novel two-component dispensing system; the provision of such apparatus which can precisely control dispensing pressure; the provision of such apparatus which will dispense two components in matched or ratioed quantities; the provision of such apparatus which can be operated from an electric power source; the provision of such apparatus which can utilize a standard electric drill for motive power; the provision of such apparatus which is easily loaded; the provision of such apparatus which is easily operated; the provision of such apparatus which is highly reliable and which is of relatively simple and inexpensive construction. Other objects and features will be in part apparent and in part pointed out hereinafter.

SUMMARY OF THE INVENTION

The apparatus of the present invention is adapted to simultaneously eject a pair of mixture components from respective dispensing tubes, the tubes being provided with respective plungers. The dispensing tubes are held in side-by-side relationship in a frame and a pair of parallel push rods slide axially in the frame and have distal portions adapted to engage and drive the respective plungers. A bridge structure links the proximal ends of the push rods and provides, between the push rods, a forward facing seat. A lead screw is journaled in the frame between the push rods and reduction gearing is provided for rotating the lead screw. A lead nut engages the lead screw and is provided with a matching surface which is adapted to frictionally engage the seat in the bridge. A spring is provided for applying a biasing force pushing the matching surface against the seat. Accordingly, rotation of the lead screw will advance the lead nut with the bridge structure and the push rods to apply a pressure to the dispensing plungers which is controlled by the amount of the biasing force, any excessive force being operative to unload the matching surfaces and to allow the nut to rotate with the lead screw.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
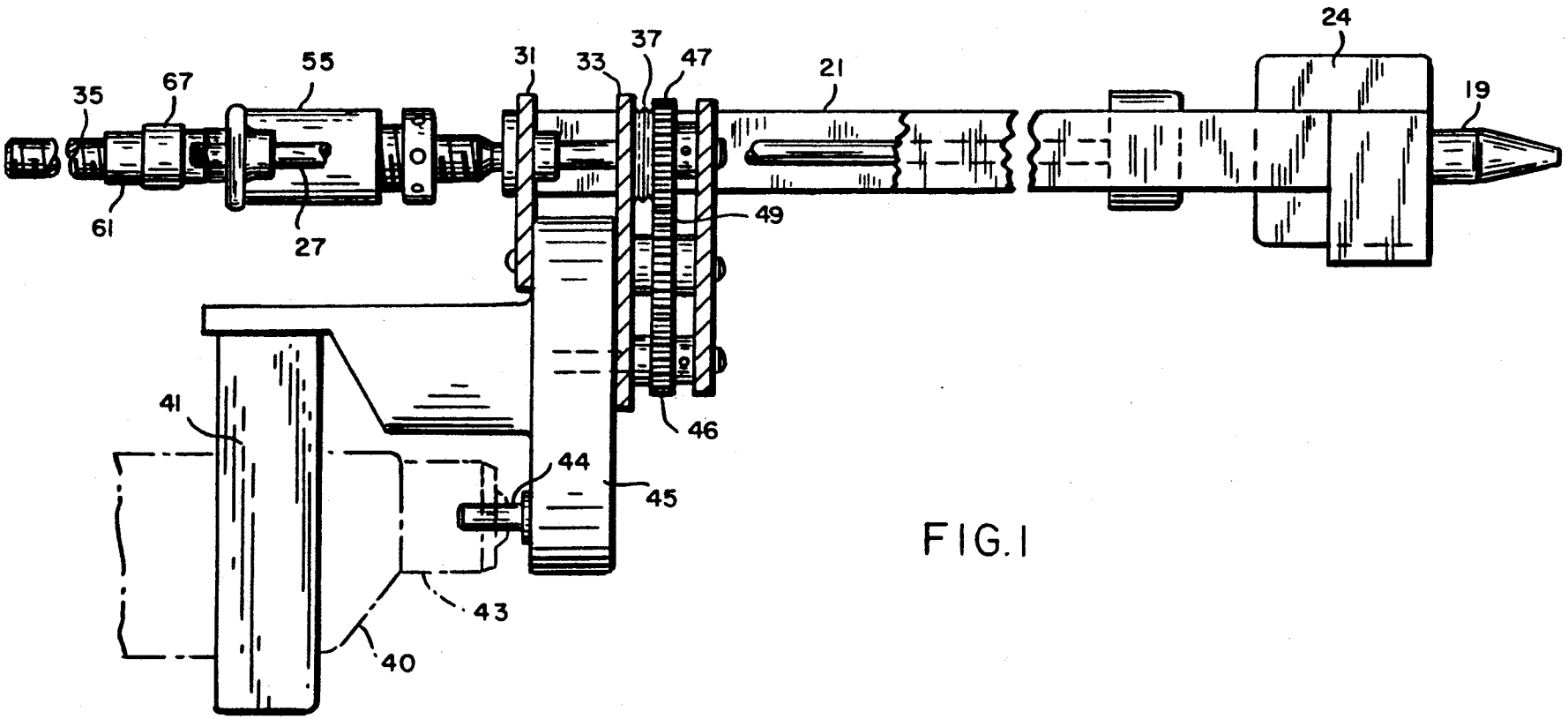
FIG. 1 is a side view, with parts broken away, of an epoxy ejection gun according to the present invention.
Figure 2:
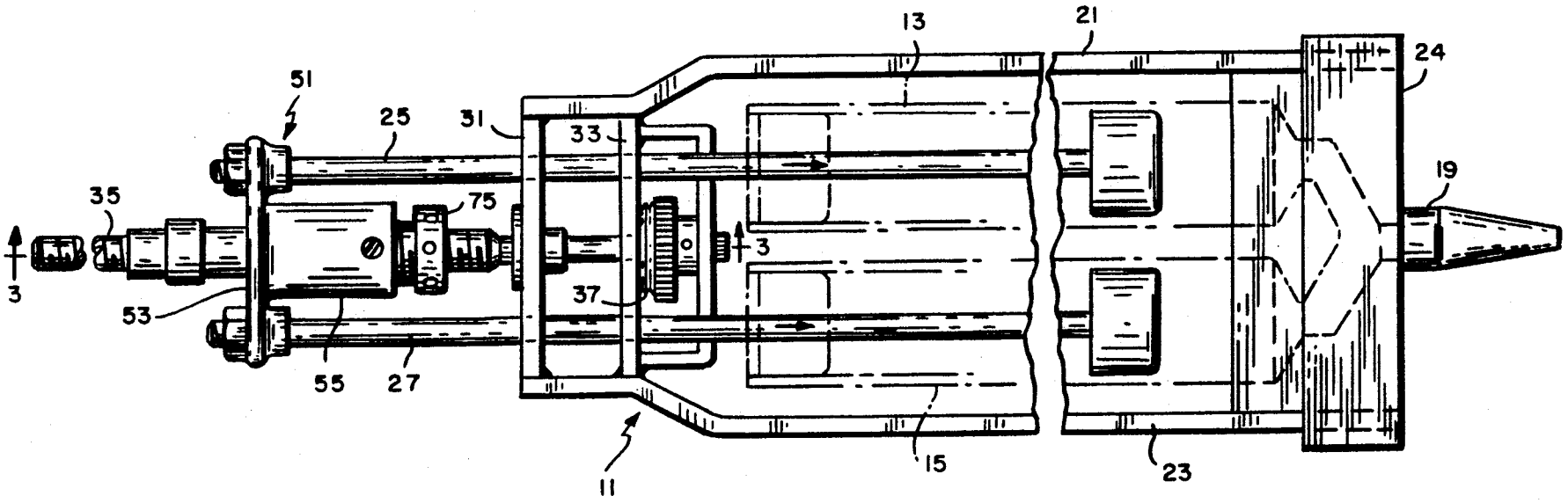
FIG. 2 is a top view of the gun of FIG. 1.

Referring now to FIGS. 1 and 2, the ejection apparatus illustrated includes a frame structure designated generally by the reference character 11 for holding a pair of dispensing tubes 13 and 15 which contain respective components of a bonding mixture such as an epoxy adhesive or embedment material. As is conventional, the dispensing tubes are provided with respective plungers and, in use, have their outlet ends joined by a mixing snout designated generally by reference character 19. The frame 11 includes a pair of forward extending arms 21 and 23 which carry a yoke 24 for receiving this snout.

A pair of push rods 25 and 27 are axially slidable through elongate slots in a pair of cross frame members 31 and 33. The slots restrain vertical movement of the push rods 25 and 2 but allow the spacing between the push rods to be adjusted to accommodate dispensing tubes of differing diameters. A lead screw 35 is journaled in the cross frame members 31–33 and is provided with a thrust bearing as indicated by reference character 37.

The apparatus illustrated is adapted to be driven by a conventional electric drill 40 which can be held in position relative to the frame 11 by clamp means indicated generally by reference character 41 so that the drill chuck 43 can engage an input shaft 44 on a reduction gear box designated generally by reference character 45. The reduction gear box 45 drives an output gear 46.

A gear 47 is mounted on the forward end of the lead screw 35 and this gear can be driven from the reduction gear box 45 through a relay gear 49. The gear 47 is relatively small so that the push rods 25 and 27 can be brought close enough together to accommodate the smallest size of dispensing tubes likely to be encountered and thus all speed reduction is accomplished separately from the gears 47 and 49.

By placing the lead screw 35 directly between the two push rods 25 and 27, cocking forces which would tend to bend the lead screw or cause binding of the nut are avoided. As will be understood by those skilled in the art, the mixture components used in two part systems such as epoxys are typically very viscous and thus the pressures required to eject the compounds are correspondingly high. The ejection forces, if exerted off-axis, could cause unwanted binding and sticking of the mechanism.

The proximal ends of the push rods 25 and 27 are linked by a bridge structure designated generally by reference character 51. Bridge structure 51 includes an endplate 53 and a generally cylindrical socket 55. The endplate 53 may have holes at different radial spacings to accommodate differing separations of the push rods so as to accommodate dispensing tubes of different sizes.

Figure 3:
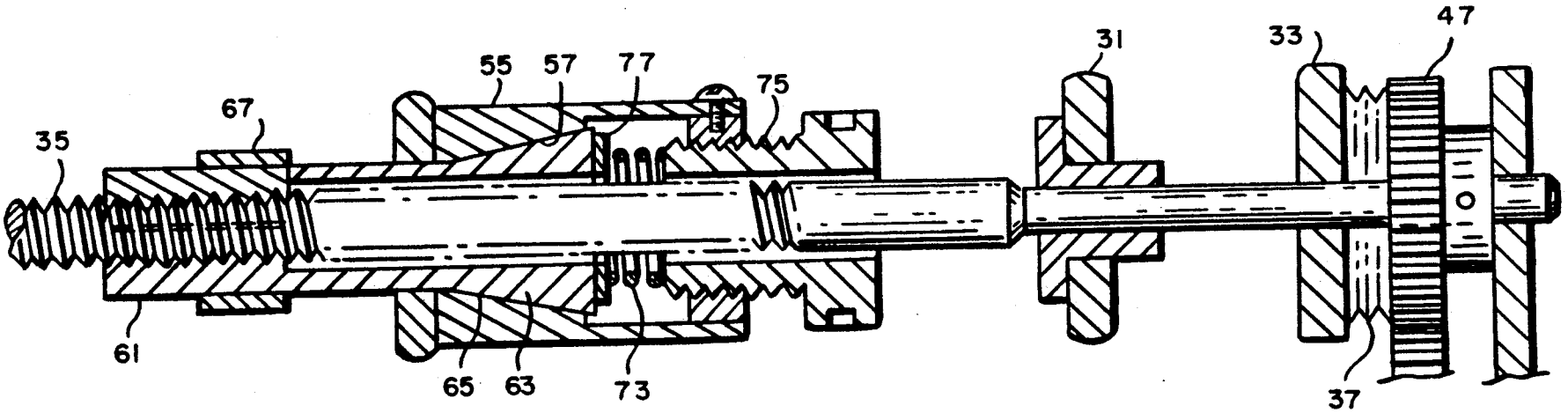
FIG. 3 is a sectional view, taken substantially on the line 3—3 of FIG. 2, showing details of a force modulating mechanism employed in the epoxy ejection gun.

As is illustrated in greater detail in FIG. 3, the socket 55 includes a seating surface 57 which, in the particular embodiment illustrated, expands conically in the forward direction, that is, toward the dispensing cartridges. A split lead nut 61 is engageable with the lead screw 35 and, integral with the lead nut, is an extension 63 which includes a tapered exterior surface 65 shaped to match or mate with the seat 57 in the socket 55. Again, in the embodiment illustrated, the matching surfaces are conical but it should be understood that other matching shapes might also be used, e.g. spherical.

The lead nut is split into two sections which are normally held together and in engagement with the lead screw 35 by a ring 67. The ring 67 may, however, be slid forward to permit the two halves of the nut be separated and to allow the bridge structure 51 and push rods 25 and 27 to be pulled back for loading of new dispensing tubes without having to back down the lead screw 35.

The tapered extension on the lead nut 61 is biased into engagement with the conical seat 57 by means of a spring 73. Pressure on the spring 73 may be adjusted by means of a threaded spindle 75 to obtain a desired or preselected level of force. A thrust bearing 77 is provided at the end of the spring 73 so that the lead nut 61 can rotate essentially independently of the socket structure 55. As in explained in greater detail hereinafter, the ejection force or pressure is controlled by means of the friction between the matching tapered surfaces and this friction is in turn directly adjustable by means of the setting of the spring pressure To operate the tool once dispensing tubes have been placed in position, the drill 40 is energized to effect rotation of the lead screw. Rotation of the lead screw in turn causes the lead nut 61 to advance to the right as shown in the drawings, carrying the bridge structure 51 and the push rods 25 and 27 with it. Advancement of the push rods in turn ejects the two components from the respective dispensing tubes 13 and 15. However, once a pressure is reached which corresponds to the spring or bias force setting, any additional reaction force on the push rods will cause the matching surfaces of the lead nut extension and the bridge socket to try to separate and will reduce the frictional force between them. When this frictional force is reduced, the nut structure will tend to rotate with the lead screw rather than advance further and thus pressure is controlled in a very smooth and precise fashion. Further, since the lead screw is located directly between the push rods, there will be no forces tending to cock the bridge structure or to bend the lead screw or otherwise interfere with the operation of the interfitting tapered surfaces In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

We claim:

1. Apparatus for simultaneously ejecting a pair of mixture components from respective dispensing tubes, the tubes being provided with respective plungers, said apparatus comprising:

frame means for holding a pair of dispensing tubes in side by side relationship;

a pair of parallel push rods axially slidable in said frame means and having distal portions adapted for driving the plungers of dispensing tubes held in said frame;

between said push rods and parallel thereto, a lead screw journaled in said frame;

bridge means linking the proximal ends of said push rods and providing, between the push rods, a forward facing slip clutch seat;

means for rotating said lead screw;

nut means for engaging said lead screw, said nut means having a rearward facing slip clutch surface adapted to frictionally engage said seat; and spring means for applying a biasing force pushing said slip clutch surface against said seat whereby rotation of said lead screw will advance said nut means with said bridge means and push rods to apply a pressure to said plungers which is controlled by the amount of said biasing force, any excessive force being operative to unload said slip clutch surface and to allow said nut means to rotate with said lead screw.

2. Apparatus as set forth in claim 1 wherein said nut means is split to allow it to be selectively disengaged from said lead screw.

3. Apparatus for simultaneously ejecting a pair of mixture components from respective dispensing tubes, the tubes being provided with respective plungers, said apparatus comprising:

frame means for holding a pair of dispensing tubes in side by side relationship a pair of parallel push rods axially slidable in said frame means and having distal portions adapted for driving the plungers of dispensing tubes held in said frame;

between said push rods and parallel thereto, a lead screw journaled in said frame;

bridge means linking the proximal ends of said push rods and providing, between the push rods, a forward expanding seat which surrounds said lead screw;

reduction gear means for rotating said lead screw;

nut means for engaging said lead screw, said nut means having a matching surface adapted to frictionally engage said seat; and spring means for applying a biasing force pushing said matching surface into said seat whereby rotation of said lead screw will advance said nut means with said bridge means and push rods to apply a pressure to said plungers which is controlled by the amount of said biasing force, any excessive force being operative to unload said matching surface and to allow said nut means to rotate with said lead screw.

4. Apparatus as set forth in claim 3 wherein said spring means comprises a coil spring surrounding said lead screw.

5. Apparatus as set forth in claim 4 further comprising an annular bushing threaded into said bridge means and bearing on one end of said coil spring for adjusting the biasing force.

6. Apparatus as set forth in claim 3 wherein said nut means is split to allow it to be selectively disengaged from said lead screw.

7. Apparatus as set forth in claim 6 including an axially slidable ring for selectively maintaining said split nut in engagement with said lead screw.

8. Apparatus as set forth in claim 4 wherein said matching surfaces are conical.

9. Apparatus for simultaneously ejecting a pair of mixture components from respective dispensing tubes, the tubes being provided with respective plungers, said apparatus comprising:

frame means for holding a pair of dispensing tubes in side by side relationship;

a pair of parallel push rods axially slidable in said frame means and having distal portions adapted for driving the plungers of dispensing tubes held in said frame between said push rods and parallel thereto, a lead screw journaled in said frame;

bridge means linking the proximal ends of said push rods and providing, between the push rods, a forward expanding conical seat which surrounds said lead screw;

reduction gear means drivable from an electric motor for rotating said lead screw;

nut means for engaging said lead screw, said nut means having a tapered conical surface adapted to frictionally engage said seat; and a coil spring surrounding said lead screw for applying a biasing force pushing said conical surface into said seat;

an annular bushing surrounding said lead screw and threaded into said bridge member for adjusting the compression of said coil spring whereby rotation of said lead screw will advance said nut means with said bridge means and push rods to apply a pressure to said plungers which is controlled by the compression of said coil spring, any excessive force being operative to unload said conical surface and to allow said nut means to rotate with said lead screw.

10. Apparatus as set forth in claim 9 wherein said reduction gear means provides an external input shaft and said frame means includes a clamp for holding an electric drill with a chuck engaging said input shaft thereby to selectively rotate said lead screw upon energization of said drill.

11. Apparatus as set forth in claim 9 wherein said push rods are guided by slots in said frame which allow the separation between the push rods to be adjusted to accommodate dispensing tubes of differing sizes.

* * * * *